United States Patent [19]

Ishiguro et al.

[11] Patent Number: 5,020,987

[45] Date of Patent: Jun. 4, 1991

[54] PULSE COMBUSTION DEVICE

[75] Inventors: Katsusuke Ishiguro; Nobuyoshi Yokoyama, both of Nagoya, Japan

[73] Assignee: Paloma Kogyo Kabushiki Kaisha, Nagoya, Japan

[21] Appl. No.: 341,916

[22] Filed: Apr. 24, 1989

[30] Foreign Application Priority Data

Apr. 22, 1988 [JP] Japan ..... 63-100697

[51] Int. Cl.[5] ..... F23C 11/04

[52] U.S. Cl. ..... 431/1; 431/12; 60/39.77; 60/39.8

[58] Field of Search ..... 431/1, 90, 11; 122/24; 60/39.76, 39.77, 39.8

[56] References Cited

U.S. PATENT DOCUMENTS

| | | | |
|---|---|---|---|
| 2,898,978 | 8/1959 | Kitchen et al. | 431/1 |
| 4,061,463 | 12/1977 | Bennett | 431/1 X |
| 4,276,857 | 7/1981 | Martin | 431/1 X |
| 4,697,358 | 10/1987 | Kitchen | 431/1 X |
| 4,715,807 | 12/1987 | Yokoyama . | |
| 4,768,947 | 9/1988 | Adachi | 431/90 |
| 4,832,598 | 5/1989 | Kitchen | 431/1 X |
| 4,872,832 | 10/1989 | Alexander | 431/90 |
| 4,891,003 | 1/1990 | Ishiguro | 431/1 |

*Primary Examiner*—Carl D. Price

*Attorney, Agent, or Firm*—Berman, Aisenberg & Platt

[57] ABSTRACT

In a pulse combination device including a housing forming therein a combustion chamber, a cylindrical support member joined to the housing to form a mixing chamber in open communication with the combustion chamber, a perforated end wall member coupled with an open end of the support member to permit inward flow of the air passing therethrough into the mixing chamber, a cylindrical member mounted in the center of the end wall member to form therein a gas passage in open communication with the mixing chamber, an annular plate formed with a plurality of air inlet ports and being secured to annular end surfaces of the end wall member and the cylindrical member, a shroud housing assembly arranged to form therein an air intake chamber in open communication with the inlet ports through the perforated end wall member, and a blower arranged to forcibly supply the air into the air intake chamber, a deflector plate is mounted in place in the mixing chamber to block a reverse flow of combustion products applied thereto from the combustion chamber and spaced from the annular plate to permit inward flow of the air passing therethrough into the mixing chamber, and a controller is provided to operate the blower during operation of the combustion device.

7 Claims, 3 Drawing Sheets

PULSE COMBUSTION DEVICE

BACKGROUND OF THE INVENTION

1. Field of the Invention

The present invention relates to a pulse combustion device, and more particularly to an improvement of a pulse combustion device adapted for use in a cooking instrument such as a cooking vessel or pot to heat cooling oil or water stored therein.

2. Discussion of the Prior Art

In a conventional pulse combustion device of this kind, flapper-type gas and air inlet valves are adapted to supply gaseous fuel and air into a combustion chamber, and a tailpipe is connected to an outlet port of the combustion chamber to take place therein resonant combustion of the mixture of gaseous fuel and air and to exhaust therefrom the combustion products. In FIG. 6, there is illustrated a portion of such a conventional pulse combustion device as described above which comprises a cylindrical support member forming therein a mixing chamber 1 in open communication with a combustion chamber (not shown), an end wall member 23 coupled with an open end of the support member, a cylindrical member 24 integrally secured in the center of end wall member 23 to form therein a gas passage in open communication with the mixing chamber 1, a flapper-type gas inlet valve unit 35 disposed within the cylindrical member 24 to permit inward flow of gaseous fuel passing therethrough from a gas container (not shown) into the mixing chamber 1 and to block outward flow of fuel-air mixture from the mixing chamber 1, and a flapper-type air inlet valve unit mounted to the end wall member 23 to permit inward flow of the air passing therethrough from an air intake chamber 7 into the mixing chamber 1 and to block outward flow of fuel-air mixture from the mixing chamber 1. The air inlet valve unit includes an air flapper valve 4 which reciprocates in a limited space between a valve plate 2 and a perforated backer plate 5 to open and close radial air inlet slots 3 in the valve plate 2 at a frequency of pulse combustion.

In operation of the conventional pulse combustion device, combustion products of high temperature flow reversely into the mixing chamber 1 through a flame trap (not shown) at every pulse combustion in the combustion chamber. The reverse flow of combustion products causes the air flapper valve 4 to be exposed to the high temperature of combustion products and to be abutted against the valve plate 2. This shortens the span of life of air flapper valve 4 and causes unwanted abutment noises. In the conventional pulse combustion device, except at starting thereof, the pressure in the air intake chamber is maintained at a constant value (about the atmospheric pressure), and the supply amount of air may not be decreased in accordance with a decrease of the supply amount of gaseous fuel. As a result, the supply amount of air becomes excessive, and the turn-down ratio is limited to around a value of ½.

SUMMARY OF THE INVENTION

It is, therefore, an object of the present invention to provide an improved pulse combustion device wherein the conventional air flapper valve is removed to eliminate unwanted abutment noises in operation.

Another object of the present invention is to provide an improved pulse combustion device wherein a maximum pressure in the combustion chamber can be decreased to decrease noises at all the sound wave frequencies in operation.

A further object of the present invention is to provide an improved pulse combustion device wherein the supply amount of air into the mixing chamber is adjusted in accordance with the supply amount of gaseous fuel to maintain the mixing ratio of gaseous fuel and air at an optimum value in a wide supply range of gaseous fuel thereby to expand the limit of the turn-down ratio.

According to the present invention, the objects are attained by providing a pulse combustion device which comprises a housing forming therein a combustion chamber and supporting a tailpipe connected thereto at an outlet port of the combustion chamber, a cylindrical support member joined to the housing at an inlet port of the combustion chamber to form a mixing chamber in open communication with the combustion chamber, a perforated end wall member coupled with an open end of the support member to permit inward flow of the air passing therethrough into the mixing chamber, a cylindrical member mounted in the center of the end wall member to form therein a gas passage in open communication with the mixing chamber, an annular plate formed with a plurality of air inlet ports and being secured to annular end surfaces of the end wall member and the cylindrical member, a shroud housing assembly arranged to form therein an air intake chamber in open communication with the inlet ports of the annular plate through the perforated end wall member, and a blower arranged to forcibly supply the air into the air intake chamber. In the pulse combustion device, a deflector plate is mounted in place within the mixing chamber to block a reverse flow of combustion products applied thereto from the combustion chamber through the mixing chamber and spaced from the annular plate to permit inward flow of the air passing therethrough into the mixing chamber, and a controller is provided to control operation of the blower in such a manner that the supply amount of air into the air intake chamber is decreased or increased in accordance with a decrease or an increase of the supply amount of gaseous fuel into the gas passage in the cylindrical member.

In a practical embodiment of the present invention, an electrically operated gas valve is disposed within a gas supply conduit connecting the gas passage in the cylindrical member to a source of gaseous fuel, and the controller is designed to control the rotational speed of the blower in relation to the throttle opening of the gas valve.

BRIEF DESCRIPTION OF THE DRAWINGS

Additional objects, features and advantages of the present invention will become more readily apparent from the following detailed description of a preferred embodiment thereof when considered with reference to the accompanying drawings, in which.

DESCRIPTION OF THE PREFERRED EMBODIMENT

Figure 1:
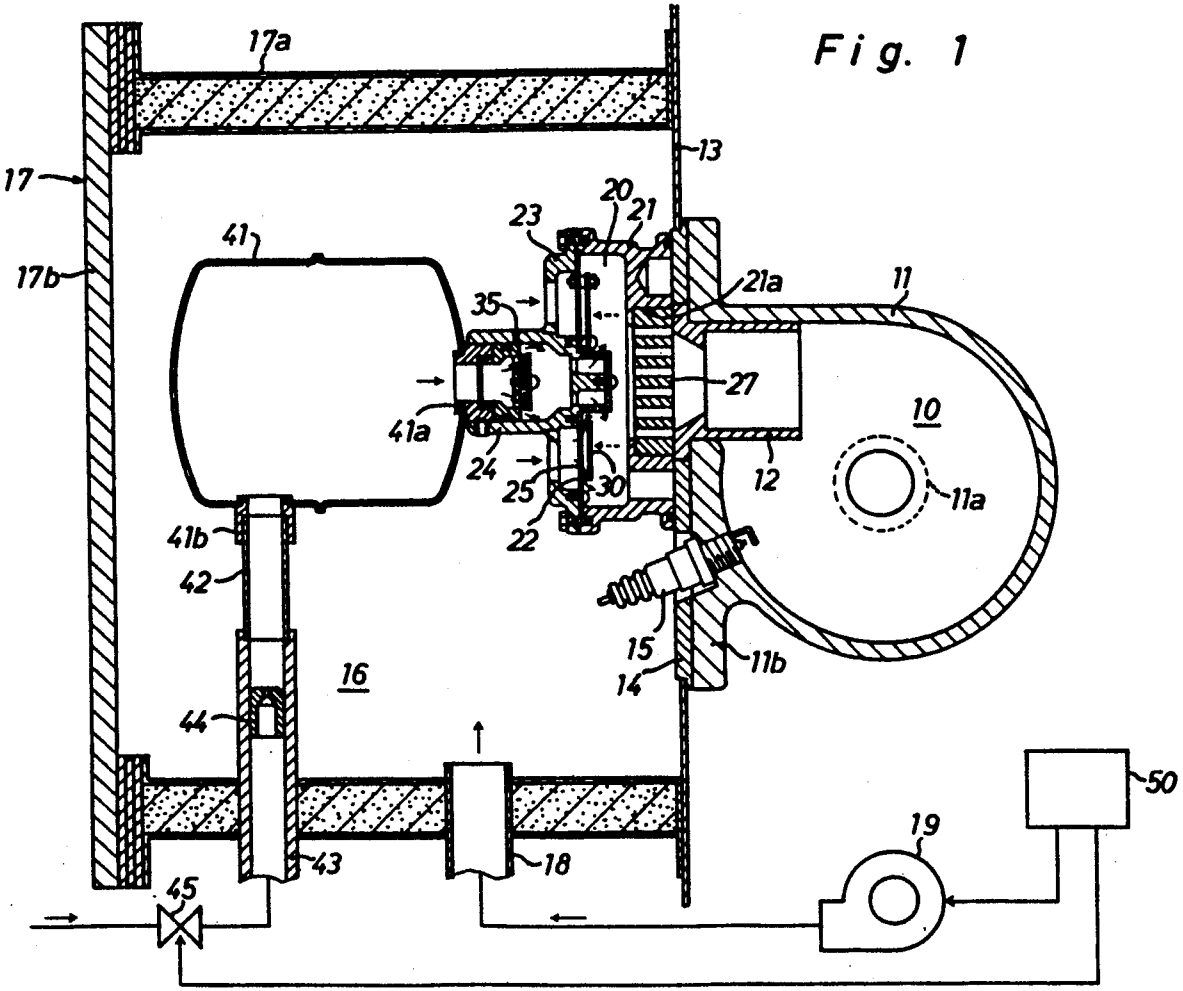
FIG. 1 is a sectional view of a pulse combustion device in accordance with the present invention.

Disclosed in FIG. 1 of the drawings is a pulse combustion device-.of the present invention which includes a housing 11 forming therein a combustion chamber 10, a cylindrical support member 21 forming therein a mixing chamber 20 in open communication with the combustion chamber 10, and a valve housing assembly coupled with an open end of support member 21. The housing 11 is disposed within a cooking vessel or pot 13 a portion of which is illustrated in the figure and has an annular flange 11*b* secured in a fluid-tight manner to a mounting plate 14 which is in turn secured to a side wall of cooking vessel 13. The annular flange llb of housing 11 is formed with an inlet opening which is aligned with an aperture in the mounting plate 14. The housing 11 has an end wall forming the combustion chamber 10 and supporting a tailpipe 11*a* connected thereto in a fluid-tight manner. The tailpipe 11*a* is fully immersed in an amount of liquid such as cooking oil or water stored in the vessel 13. The tailpipe 11*a* is arranged to receive combustion products from the combustion chamber 10 and extends outwardly from another side wall of the vessel 13 to deliver the combustion products to an exhaust. A cylindrical combustion head 12 is coupled within the inlet opening of housing 11 and positioned in place by engagement with an end face of housing 11, the configuration and size of head 12 being determined taking into account of the kind of gaseous fuel to be supplied. A spark plug 15 is mounted on the housing 11 and has an electrode located in the combustion chamber 10.

The support member 21 has a bottom wall formed with an aperture 21*a* for communication between the mixing chamber 20 and the combustion chamber 10 and is secured to the mounting plate 14 in an air-tight manner. A flame trap 27 is coupled within the bottom aperture 21*a* of support member 21 and secured in place coaxially with the combustion head 12. The flame trap 27 is in the form of a perforated disk member of ceramic material which is formed with a plurality of equi-spaced slits. The valve housing assembly includes an end wall member 23 secured in an air-tight manner to the open end of support member 21 through an annular plate 22 by means of fastening bolts, and a cylindrical member 24 integrally secured in the center of end wall member 23. The annular plate 22 is fitted to an internal seating face of wall member 23 and fixed in place by means of screws. The cylindrical member 24 forms therein a gas passage in open communication with the mixing chamber 20 in support member 21. As shown clearly in FIG. 2, the end wall member 23 forms therein an annular space 23*a* in surrounding relationship with the cylindrical member 24 and is formed with a plurality of circumferentially equi-spaced openings 23*b*. The annular space 23*a* and openings 23*b* are arranged to form a plurality of circumferentially equi-spaced air flow passages in surrounding relationship with the gas passage.

Figure 3:
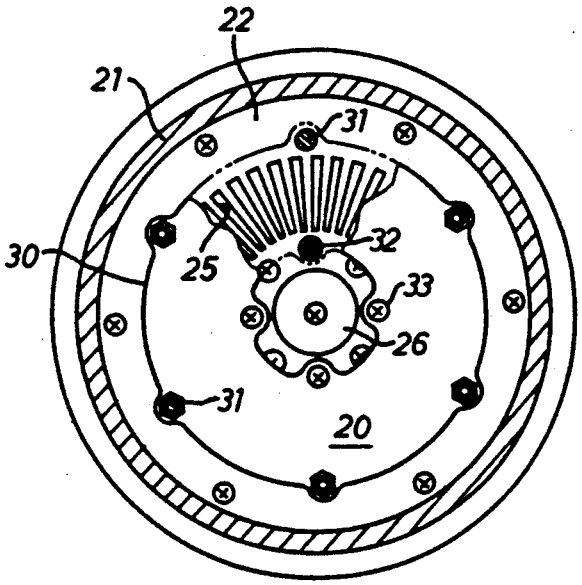
FIG. 3 is a cross-sectional view taken along line III—III in FIG. 2.
Figure 6:
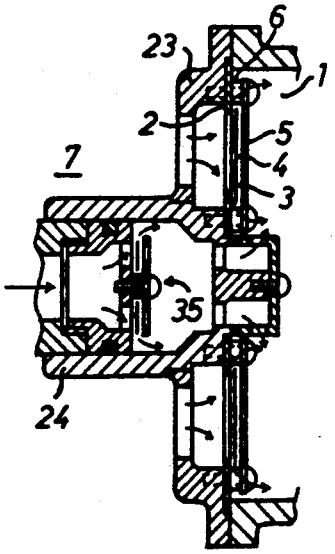
Fig. 6 (PRIOR ART)
FIG. 6 is a sectional view of an air inlet valve assembly in a prior art pulse combustion device.

As shown clearly in FIG. 3, the annular plate 22 is formed with a plurality of circumferentially equi-spaced radial air inlet slots 25 for open communication between the annular space 23*a* and the mixing chamber 20. An annular deflector plate 30 is secured to the annular plate 22 at its outer periphery by means of stepped bolts 31 and nuts threaded thereto and at its inner periphery by means of screws 33 through spacers 32. The annular deflector plate 30 is located in the mixing chamber 20 and spaced in a certain distance from the annular plate 22. As shown in the figure, the annular deflector plate 30 has a radial width enough to fully cover all the radial air inlet slots 25 of annular plate 22.

As shown in FIG. 1, a shroud housing assembly 17 is secured to the side wall of vessel 13 to contain therein a gas container 41 assembled with the support member 21 and to form therein an air intake chamber 16. The shroud housing assembly 17 is composed of a double-wall cylindrical member 17*a* filled with sand and secured at one end thereof to the side wall of vessel 13 and a side plate 17*b* secured to the other end of double-wall cylindrical member 17*a* in an air-tight manner. An air supply conduit 18 is inserted into the air intake chamber 16 through a bottom portion of double-wall cylindrical member 17*a* and is connected to a blower 19 to forcibly supply the air into the air intake chamber 16 therethrough. The blower 19 is operated under control of a controller 50 to vary the pressure in air intake chamber 16. Thus, the mixing chamber 20 is supplied with the air from intake chamber 16 through the openings 23*b*, annular space 23*a* and radial air inlet slots 25.

As shown in FIG. 1, the gas container 41 is mounted to the cylindrical member 24 and is connected to a source of gaseous fuel by means of a connecting pipe 42 and a gas supply conduit 43. The gas container 41 is made of sheet metal and has outlet and inlet sleeves 41*a* and 41*b* soldered thereto. The outlet sleeve 41*a* is coupled within the cylindrical member 24 in an air-tight manner. The connecting pipe 42 is soldered at its one end to the inlet sleeve 41*b* of container 41 and at its other end to an inner end of gas supply conduit 43. The gas supply conduit 43 is provided therein with a main nozzle 44 and an electrically operated gas valve 45 and extends into the air intake chamber 16 through the bottom portion of double-wall cylindrical member 17*a*. Within the gas passage of cylindrical member 24, a flapper-type gas inlet valve unit 35 is coupled with the outlet sleeve 41*a* of gas container 41 to allow inward flow of gaseous fuel passing therethrough from the gas container 41 into the mixing chamber 20 and to block outward flow of the mixture of gaseous fuel and air from the mixing chamber 20.

Figure 2:
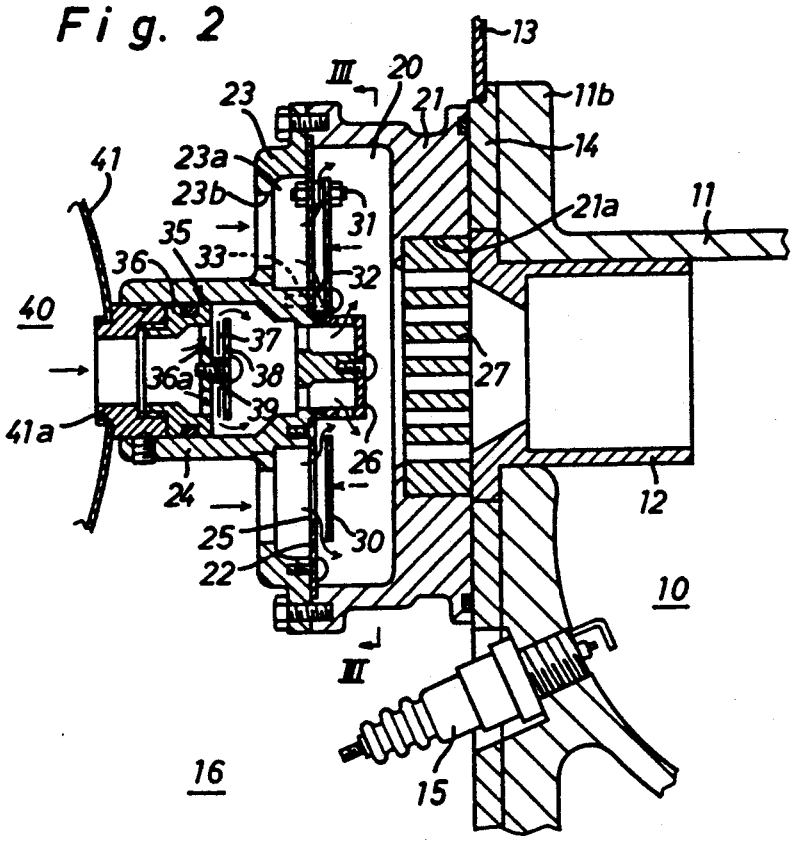
FIG. 2 is an enlarged sectional view of a portion of the pulse combustion device shown in FIG. 1.
Figure 4:
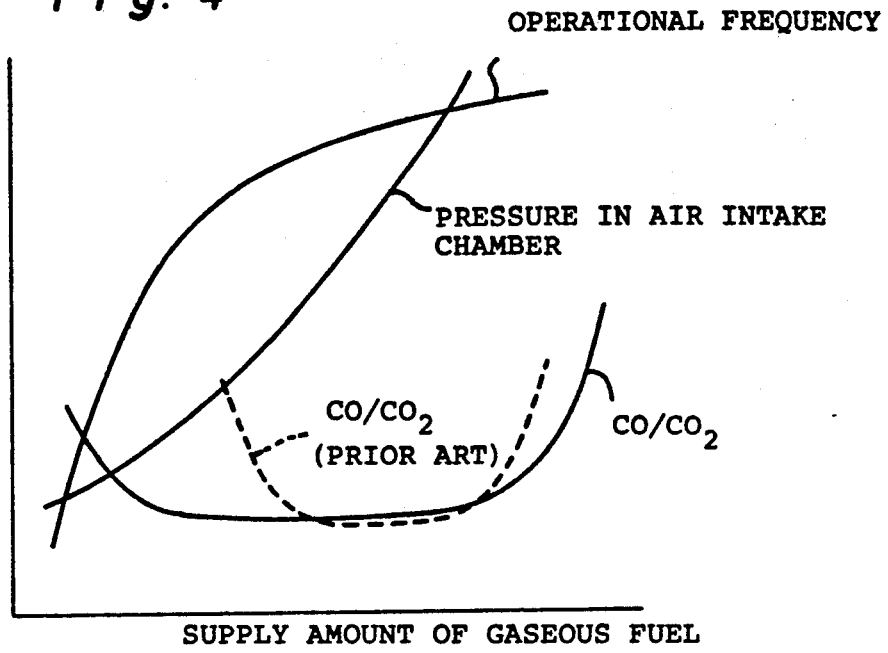
FIG. 4 is a graph illustrating a relationship between a supply amount of gaseous fuel and the pressure in an air intake chamber shown in FIG. 1.

As shown clearly in FIG. 2, the gas inlet valve unit 35 includes a cup-shaped valve body 36 screwed into the outlet sleeve 41*a*, a perforated circular backer plate 37 fixed to the valve body 36 through a spacer 39 by means of a screw, and a circular flapper 37 movable between the valve body 36 and backer plate 38. The valve body 36 has an end wall formed with a plurality of circumferentially equi-spaced radial gas inlet ports 36*a*. A cup-shaped gas distribution head 26 is screwed to the center of cylindrical member 24 and arranged within the mixing chamber 20. The gas distribution head 26 is formed with a plurality of circumferentially equi-spaced radial holes for communication between the gas passage and the mixing chamber 20. When the pressure in mixing chamber 20 is less than that in gas container 41, the flapper 37 is lifted off the radial gas inlet ports 36*a* to introduce gaseous fuel into the mixing chamber 20 from the gas container 41 through the distribution head 26. When the pressure is higher in the mixing chamber 20 than in the gas container 41, the flapper 37 is seated over the radial gas inlet ports 36*a* to block a reverse flow of gaseous fuel from the mixing chamber 20. In addition, the controller 50 is designed to control the throttle opening of gas valve 45 and to control the rotational speed of blower 19 in such a manner as to increase the pressure in air intake chamber 16 in accordance with an increase in the supply amount of gaseous fuel as shown in FIG. 4.

At the initial stage of operation of the pulse combustion device, the controller 50 is set in a condition where the rotational speed of blower 19 and the throttle opening of gas valve 45 are each controlled in an appropriate value suitable for start of the pulse combustion device. Thus, the gaseous fuel from gas container 41 is supplied into the mixing chamber 20 through the gas inlet value unit 35 and gas distribution head 26, while the air from intake chamber 16 is supplied into the mixing chamber 20 through the openings 23*b*, annular space 23*a* and radial air inlet ports 25. The gaseous fuel is mixed with the incoming air in the mixing chamber 20 and supplied into the combustion chamber 10 through the flame trap 27 and combustion head 12. On start up, the mixture of gaseous fuel and air in the combustion chamber 10 is ignited by energization of the spark plug 15 under control of the controller 50. The pressure of the resulting rapid combustion of the mixture closes the gas inlet valve unit 35 and forces the combustion products of high temperature to exhaust from the tailpipe 11*a*. When resonant combustion is initiated, oscillation takes place in the tailpipe 11*a*, creating positive and negative pressures in the tailpipe 11*a*.

During periods of negative pressure in the combustion chamber 10, the radial air inlet slots 25 of annular plate 22 allows the flow of fresh air introduced therethrough into the mixing chamber 20, and simultaneously the gas inlet valve unit 35 is opened to introduce fresh gaseous fuel into the mixing chamber 20 from gas container 41. The mixture of fresh gaseous fuel and air created in the mixing chamber 20 is reignited by a flame caused by the resonant pulse combustion. The reignition of each fresh air-fuel mixture is continuously repeated at a frequency, for instance, about 100 cycles per second. During intermittent periods of positive pressure in the combustion chamber 10, the combustion products of high temperature reversely flow into the mixing chamber 20 through the combustion head 12 and flame trap 27 and tend to further flow into the air intake chamber 16 and gas container 41 respectively through the radial air inlet slots 25 of annular plate 22 and the radial holes of gas ditribution head 26. In this instance, the reverse flow of combustion products directed to the radial air inlet slots 25 is first blocked by the deflector plate 30 and impeded for one moment by the inertia of the gas, while the gas inlet valve unit 35 is closed to block the reverse flow of combustion products directed thereto from the distribution head 26. Thus, such an amount of the combustion products is very little as can reverse into the radial air inlet slots 25 of annular plate 22 before the next suction cycle starts.

Figure 5:
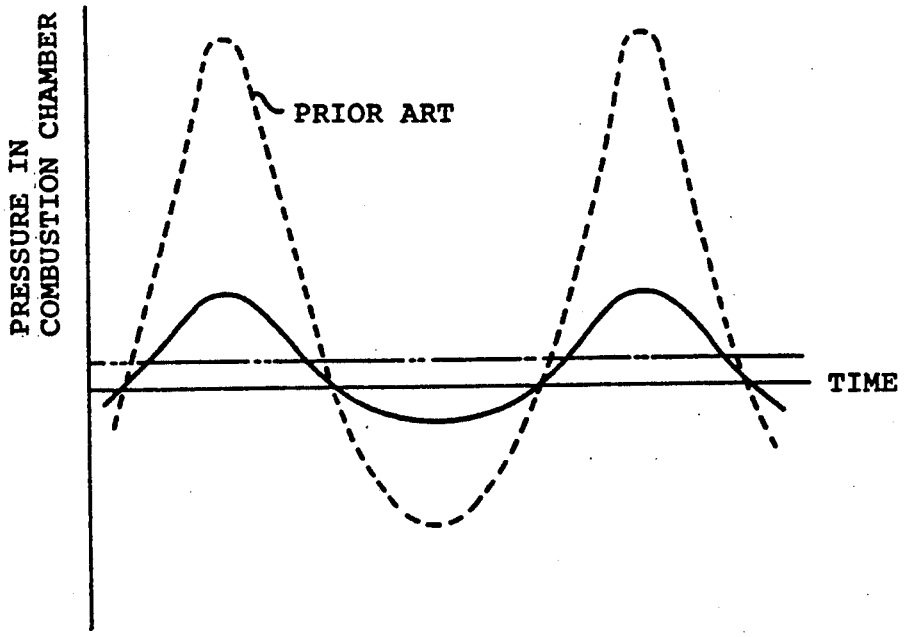
FIG. 5 is a graph illustrating fluctuation of the pressure in a combustion chamber shown in FIG. 1.

In the pulse combustion device described above, there is no necessity to provide a conventional air flapper reciprocable in the mixing chamber 20 for blocking the reverse flow of combustion products. Thus, prevented with the pulse combustion device are unwanted noises caused by intermittent abutments of the air flapper against the associated valve plate. Since in operation a small amount of the combustion products can reverse into the radial air inlet slots 25 of annular plate 22, the pressure in combustion chamber 10 fluctuates as shown by a solid line in FIG. 5. In comparison with pressure fluctuation in a conventional pulse combustion device shown by a broken line in FIG. 5, a maximum pressure in the combustion chamber 10 greatly decreases. This is effective to decrease noises in operation of the pulse combustion device at all the sound wave frequencies. Although the gas flapper 37 is provided in the gas inlet valve unit 35, it is located in the cylindrical member 24 which is covered with the distribution head 26. Thus, the possibility of damages of the gas flapper can be disregarded since the reverse flow of combustion products is blocked by the distribution head 26. In a practical embodiment of the present invention, the gas inlet valve unit 35 may be replaced with such a deflector plate as adapted to the air inlet slots 25 of annular plate 22.

It is also to be noted that in the pulse combustion device the blower 19 and gas valve 45 are operated under control of the controller 50 to control the pressure in air intake chamber 16 in accordance with the supply amount of gaseous fuel as shown in FIG. 4. This is effective to maintain the mixing ratio of gaseous fuel and air at an optimal value in a wide supply range of gaseous fuel and enables the turn-down ratio to be about a value of ⅓. The properiety of the mixing ratio can be judged from $CO/CO_2$. In the pulse combustion device, the $CO/C0_2$ ratios are distributed in a wide range around a minimum value as shown by a solid line in FIG. 4. In the conventional pulse combustion device, except at starting thereof, the pressure in the air intake chamber is maintained at a constant value (about the atmospheric pressure), and the supply amount of air may not be decreased in accordance with a decrease of the supply amount of gaseous fuel. As a result, the supply amount of air becomes excessive to cause $CO/CO_2$ ratios to be in a narrow range around a minimum value as shown by a broken line in FIG. 4. Consequently, the turn-down ratio is limited to around a value of ½. For reference, operational frequencies of the pulse combustion device is shown by a solid line in FIG. 4.

Although in the above-described embodiment, the blower 19 is operated under control of the controller 50 to control the pressure in air intake chamber 16, it may be replaced with a damper valve disposed within the air supply conduit 18 or a damper valve disposed within an opening of the shroud housing assembly for communication between the air intake chamber 16 and the atmospheric air. In such a modification, the throttle opening of the damper valve is adjusted under control of an appropriate controller.

Although the preferred embodiment of the present invention has been shown and described, it should be understood that various modifications and rearrangement of the parts may be resorted to without departing from the scope of the invention as disclosed and claimed herein.

What is claimed is:

1. A pulse combustion device comprising a housing forming therein a combustion chamber and supporting a tailpipe connected thereto at an outlet port of the combustion chamber; a cylindrical support member joined to said housing at an inlet portion of the combustion chamber to form a mixing chamber in open communication with the combustion chamber; a perforated end wall member coupled with an open end of said support member to permit air supplied therethrough to enter into the mixing chamber; a central cylindrical member mounted in the center of said endwall member to form therein a gas passage in open communication with the mixing chamber; an annular plate formed with a plurality of air inlet ports and being secured to annular end surfaces of said end wall member and said central cylindrical member; a shroud housing assembly arranged to form therein an air intake chamber in open communication with the inlet ports of said annular plate through said perforated end wall member; and a blower arranged to forcibly supply air into the air intake chamber;

wherein a deflector plate is mounted in place within the mixing chamber to block a reverse flow of combustion products applied thereto from the combustion chamber through the mixing chamber and spaced from said annular plate without intervention of an air-flapper valve to permit inward flow of the air passing therethrough into the mixing chamber, and wherein a controller is provided to control operation of said blower according to the amount of gaseous fuel supplied into the mixing chamber during operation of the pulse combustion device.

2. A pulse combustion device as claimed in claim 1, wherein a flapper-type gas inlet valve unit is disposed within said cylindrical member to allow inward flow of gaseous fuel passing therethrough into the mixing chamber and to block outward flow of the gaseous fuel from the mixing chamber, and wherein said controller is designed to control the operation of said blower in such a manner that the supply amount of air into the air intake chamber is decreased or increased in accordance with a decrease or an increase of the supply amount of gaseous fuel into the gas passage in said cylindrical member.

3. A pulse combustion device as claimed in claim 2, wherein an electrically operated gas valve is disposed within a gas supply conduit connecting the gas passage in said cylindrical member tO a source of gaseous fuel, and wherein said controller is designed to control the rotational speed of said blower in relation to the throttle opening of said gas valve.

4. A pulse combustion device as claimed in claim 1, wherein said annular pate is formed with a plurality of circumferentially equi-spaced radial air inlet slots, and said deflector plate is an annular plate secured at its outer periphery to said annular plate and at its inner periphery to said cylindrical member to cover all the radial air, inlet slots of said annular plate and spaced from said annular plate to permit inward flow of the air passing therethrough into the mixing chamber.

5. A pulse combustion device as claimed in claim 1, wherein a gas container is mounted to said cylindrical member and contained in the air intake chamber, said gas container having an inlet port connected to a source of gaseous fuel and an outlet port in open communication with the gas passage in said cylindrical member.

6. A pulse combustion device as claimed in claim 1 wherein a flame trip coupled within a bottom wall of said support member and located between the mixing chamber and the combustion chamber.

7. A pulse combustion device as claimed in claim 6, wherein a cylindrical combustion head is coupled within the inlet port of the combustion chamber coaxially with said flame trap to permit passage of the mixture of gaseous fuel and air passing therethrough from said flame trap into the combustion chamber.

* * * * *